United States Patent [19]

Governale

[11] Patent Number: 5,065,479

[45] Date of Patent: Nov. 19, 1991

[54] VENTURI-TYPE CONVEYOR FOR FIBER LAYING IN NONWOVEN MATERIAL PRODUCTION

[76] Inventor: Claudio Governale, Via Venezia, 44, 35100 - Padova, Italy

[21] Appl. No.: 505,128

[22] Filed: Apr. 6, 1990

[30] Foreign Application Priority Data

Apr. 6, 1989 [IT] Italy ..... 41564 A/89

[51] Int. Cl.[5] ..... D01G 15/46

[52] U.S. Cl. ..... 19/303

[58] Field of Search ..... 19/303–306

[56] References Cited

U.S. PATENT DOCUMENTS

| | | | |
|---|---|---|---|
| 3,768,119 | 10/1973 | Wood | 19/306 |
| 3,768,120 | 10/1973 | Miller | 19/306 |
| 3,792,943 | 2/1974 | Helgesson | 19/304 X |
| 3,825,381 | 7/1974 | Dunning et al. | 19/303 X |
| 3,863,295 | 2/1975 | Castor | 19/305 X |
| 4,130,915 | 12/1978 | Gotchel et al. | 19/304 |
| 4,224,720 | 9/1980 | Morgner et al. | 19/303 X |
| 4,706,338 | 11/1987 | Anspach | 19/304 X |

FOREIGN PATENT DOCUMENTS

| | | | |
|---|---|---|---|
| 1809761 | 8/1969 | Fed. Rep. of Germany | 19/305 |
| 1147785 | 3/1985 | U.S.S.R. | 19/304 |
| 2118984 | 11/1983 | United Kingdom | 19/304 |

*Primary Examiner*—Werner H. Schroeder
*Assistant Examiner*—John J. Calvert
*Attorney, Agent, or Firm*—Hoffman, Wasson & Gitler

[57] ABSTRACT

A device for producing fibrous non-woven structures. The device includes a first duct for conveying an air flow over the lateral surface of a carding cylinder to remove the fibers from the carding cylinder and to convey them to a mobile forming surface. It further includes a second duct joining with the first, wherein a flow of compressed air is passed through the second duct to create in the first duct the air flow utilized in removing the fibers. In addition, an adjusting member is provided, faced to said first duct, at the downstream, end of said second duct, to adjust its outlet section.

10 Claims, 2 Drawing Sheets

VENTURI-TYPE CONVEYOR FOR FIBER LAYING IN NONWOVEN MATERIAL PRODUCTION

BACKGROUND OF THE INVENTION

The present invention refers to a device for producing fibrous non-woven structures.

Various sectors of industry use non-woven fabrics of different thickness and conformation to cover, isolate and protect. For example, non-woven materials are used in the fields of clothing, furniture, car industry, civil engineering, and in all other fields where its use seems more convenient with respect to the traditional woven materials.

The fibrous structures, or non-woven webs, are generally produced through machines distributing fibers on a mobile surface that, once cohesive, form a compact structure with a constant thickness.

These well-known machines, used to obtain non-woven fabrics with a disordered structure, consist of a plurality of cylinders for carding the fibers and a fan, placed upstream the last carding cylinder, to convey an air flow in a duct having a "Venturi section".

The Venturi section is obtained through a metallic frame tangent to part of the lateral surface of the carding cylinder. The section sizes give the air flow, which runs through it, speed and pressure enough to free the fibers from the clothing of the carding cylinder and set them down onto a mobile surface placed downstream of said section. This surface is generally formed by a perforated drum or screen belt, which allows air to be drawn away.

These known machines present various drawbacks, both from a practical and economical point of view. Further, they do not complete the production cycle of non-woven webs.

In fact, the fiber cohesion is generally made by other machines using solutions of glue and water sprayed on the fibrous structure.

This reinforcement method, which is applied after the structure is formed using a fluid different from air, alters the fibers distribution on the mobile surface, thus comprising the final homogeneity of the product.

Another drawback of these known machines is that the carding cylinder, and its fastening and transmission mechanisms, undergo an unavoidable obstruction of dust and fibers due to the air flow. For these reasons, this kind of machine needs particular structures and materials, as well as an accurate and complex manufacturing.

Another drawback of some of these machines is that they produce non-woven fabrics only in certain weights or thicknesses, and can be varied only by overlapping different layers.

Other machines are know, which use compressed air flows downstream of a Venturi section and create a high depression on the carding cylinder at the same level of the section itself. This depression frees fibers from the cylinder and distributes them on the underlying surface.

Another great drawback of these machines is that the compressed air flows are generated by constant sections, and cannot be varied in their intensity. On the other hand, the possibility of increasing or decreasing the air volume and speed according to the kind of fibers and the final product thickness, allows for a sensible improvement in the fibers distribution on the mobile surface to obtain a more homogenous non-woven fabric.

Another drawback of these machines is that the ducts for compressed air flows are subjected to very high pressure. As a result manufacturers are compelled to use special materials for some parts of the machines. However, very high thickness are often required when common materials are used which may cause problems with respect to encumbrance and manufacturing of the machines.

Another drawback of these machines is that the particular building structure does not allow for easy maintenance operations, especially the cleaning of the Venturi section and of the other sections generating the air flows.

SUMMARY OF THE INVENTION

The aim of the present invention is to realize a device that, according to the fibers used, allows for changes in the air flow range and the width of Venturi section, according to the desired thickness of the final product and the other fibers used.

Another aim of the invention is to realize a device easily applied on a variety of carding machine.

Another aim of the invention is to realize a device which, by using common materials and thicknesses is able to absorb the heavy stress they undergo.

Another aim of the invention is to realize a device which can cohesively join the fibrous structure without altering its homogeneity.

Another aim of the invention is to realize a device allowing for easy cleaning and maintenance operations.

Another aim of the invention is to realize a device able to produce a variety of non-woven fabrics, using all kinds of fibers and having various thicknesses.

All these aims and others which will be apparent from the following specification are reached, according to the invention, through a device for producing non-woven structures, comprising a first duct conveying an air flow over the lateral surface of a carding cylinder. The air flow removes the fibers from the carding cylinder and conveys them to a mobile forming surface where non-woven structures may be produced. The device further includes a second duct in fluid communication with the first duct, wherein flow of compressed air is passed through the second duct to create the air flow necessary for removing the fibers in the first duct. The flow of compressed air is controlled by an adjusting member located at the downstream end of the second duct.

BRIEF DESCRIPTION OF THE INVENTION

The present invention is furtherly explained below in a preferred embodiment which is not given as a limiting example, with reference to the attached drawings, in which.

DESCRIPTION OF THE PREFERRED EMBODIMENT OF THE INVENTION

Figure 1:
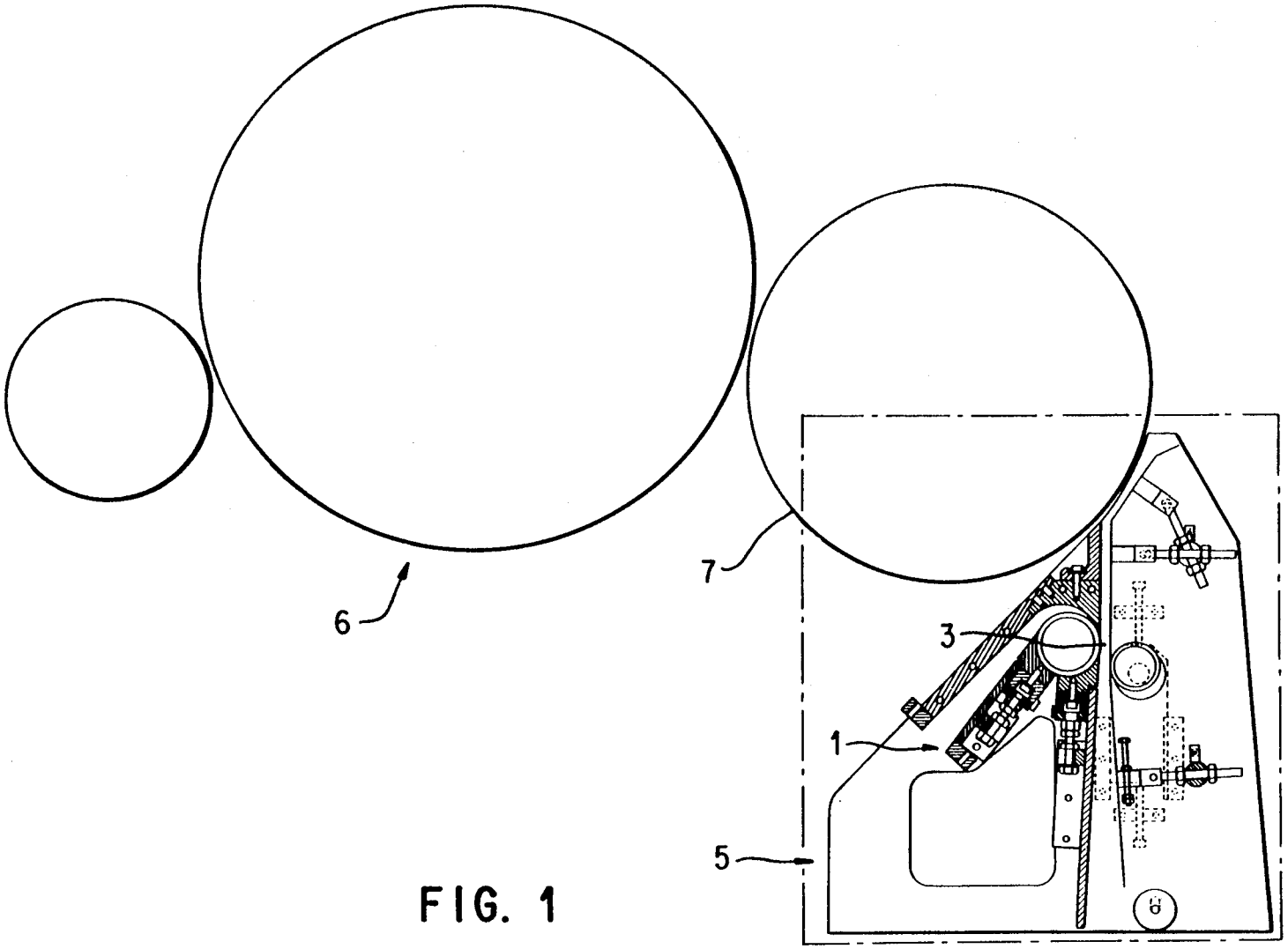
FIG. 1 shows a longitudinal section of the device according to the invention applied to carding rolls.
Figure 2:
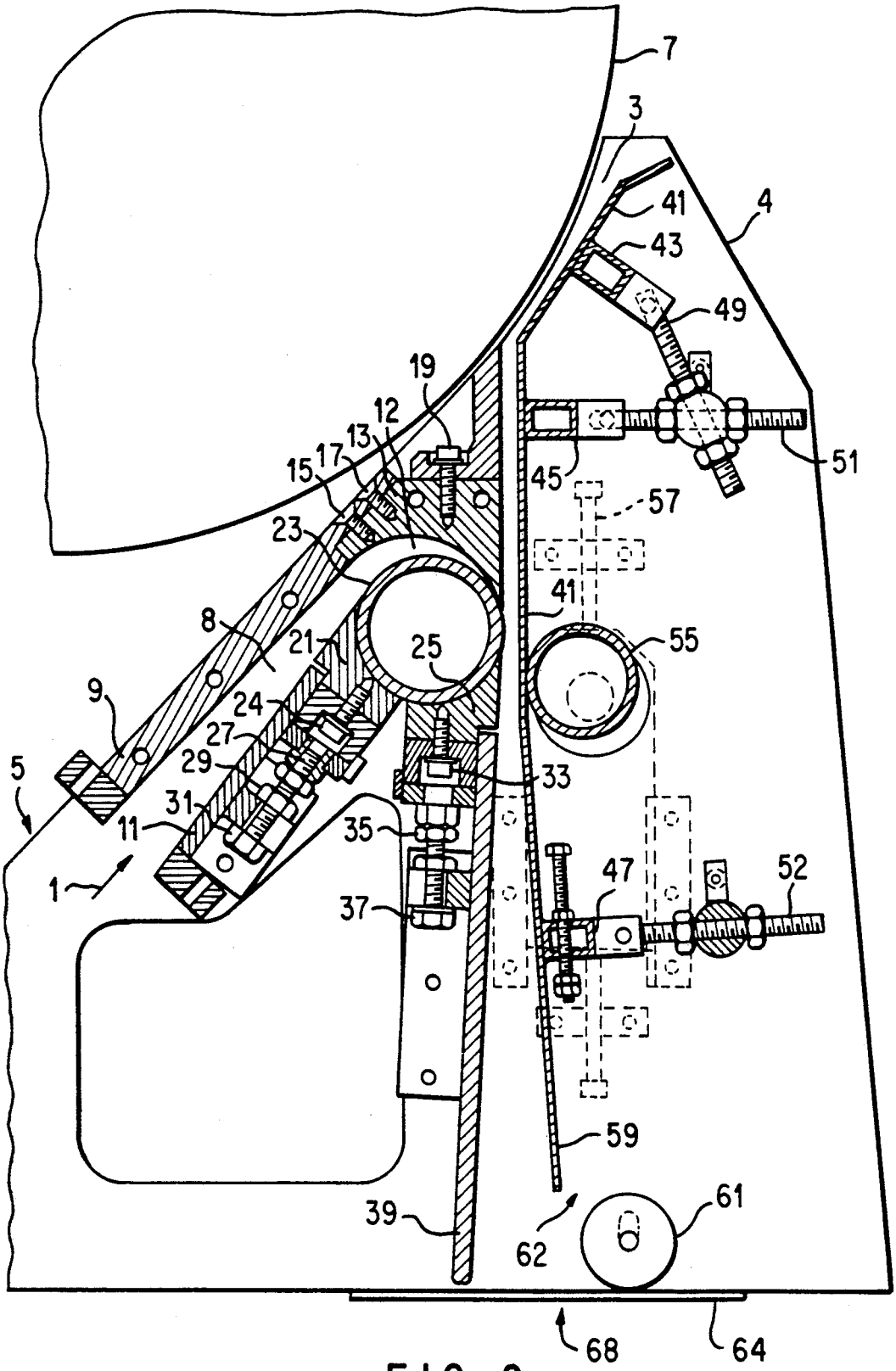
FIG. 2 shows an enlargement of the particular surrounded by the dotted line in FIG. 1.

As can be seen from the drawings, the device according to the invention essentially consists of two parts:

the first one, including a duct 1, tapered and with an adjustable terminal section, to generate compressed air flows at variable speed, and the second one, comprising a duct 3, having a Venturi section, adjustable in its sizes and able to distribute on a mobile surface the fibrous material conveyed by the air flow.

More particularly, the device according to the invention comprises a generally trapezoid frame 5, which is adjacent to the lateral surface of a carding cylinder 7, consisting of the a card comb to attached to the doffen roll, to which the device is connected.

The assembly 6 comprises a plurality of cylinders rotating in opposite directions toward one another, and are provided with teeth or clothing able to card the fibers of the material to be treated.

The first part 8 of the duct 1 is made of two flat surfaces 9, 11, placed in symmetric position and stiffly connected to the structure 5.

The final part 12 of the duct 1 has an air adjustable section. It is made by a cylinder 23, leaning on two movable blocks 21, 25, and by a curve block 13, connected to the structure 5 by bolts 15, 17, 19.

The blocks 21 and 25 are concavely shaped with respect to the arcutate surface of the cylinder 23 and are millimetrically adjustable in elevation through bolts 24, 27, 29, 31, 37, 35, 33. It should also be noted that the concave surfaces of the blocks 21 and 25 are upwardly directed with respect to the cylinder 23.

Said bolts 24, 27, 29, 31 regulate the movement of block 21 and engage in plates welded on an inclined wall 39.

The blocks 25 and 13, the lateral walls 4 of the structure 5 and the wall 39 make up the three fixed sides of the duct 3. The forth side of duct 3 is movable sluice board 41. As previously discussed, block 25 is adjustable to allow the displacement of the cylinder 23, but it is always aligned with the block 13 to form a fixed wall of the duct 13.

The sluice board 41 is reinforced by hollow sections 43, 45, 47, longitudinally welded on the sluice board and connected to the structure 5 through bolts 49, 51, 52.

These bolts allow a translation of the sluice board 41 with millimetrical movements, by rotating the bolts 49, 51, 52 with respect to the fixed nuts.

The adjusting of the bolts 49, 51, 52 and of a moveable cylinder 55, which is connected to the structure 5 by a bolt 57, allow the width of the duct 3 to be changed with independent movements.

The final part 59 of the sluice board can be moved along the surface of the sluice board 41 and its movement regulates the width of the free section 62 delimited by a movable roll 61, which limits the suction flow of the mobile surface 64.

The device according to the invention operates as follows:

The material necessary to produce the non-woven fabrics is fed in a silo placed over the card.

At the same time the carding rolls are started in motion, the compressors are driven, which generate a flow of compressed air, running through the duct 1 into the duct 3.

Upstream the joining point of the duct 1 in the duct 3, an air flow generated by depression passes over the surface of the comber cylinder 7 of the card freeing the fibers withheld by card clothing and conveying them towards the mobile surface.

The flow induced by the compressed air running through the Venturi section duct 3 increases its speed and pressure proportionally to the distance from the inlet section.

The best fiber distribution on the mobile surface 64, and therefore the best homogeneity of the final product, are obtained by varying the volume and the speed of the air flow according to the fiber weight, dimensions, and thickness of the desired final product.

These parameters are changed by adjusting the air flow and the dimensions of the duct 3 and of the section 62.

The air flow changes by adjusting the final section of the duct 1. This is accomplished by moving the cylinder 23 closer to, or away from, the curve surface of the block 13.

The section of the duct 3 is changed by moving the sluice board 41.

Said translation is obtained by acting on the bolts 49, 51, 52 and the cylinder 55 through the bolt 57.

The Venturi effect is obtained in the duct 3 by reducing the section passed through by the compressed air flow and by increasing the dimensions of the two far sections.

The final part of the duct 3 acts as a diffusor and allows a more homogeneous distribution of fibers on the mobile surface 64.

According to the air volume and to the speed in the duct 3, the dimension of the outlet 62 is adjusted.

This outlet stops air flow induced through the mobile surface 64, whose flow could alter the fiber distribution and the product homogeneity.

Synthetic binder can be fed through the inlet of duct 3 or through section 62 to improve the cohesion of the fibrous structure produced on the mobile surface 64.

The cylinder 23, which is able to adjust the air flow by being simply leaned against the blocks 21, 25, can be easily removed to allow the maintenance and cleaning operations of the final part of the duct 1.

The device according to the instant invention produces several practical and economic advantages. In particular, it allows:

production of non-woven fabrics of varying thickness, by using a variety of fibers;

the manufacture of non-woven materials with common materials of a thickness apt to absorb the heavy stress they undergo;

carrying out the cohesion of the fibrous structure without altering its homogeneity;

carrying out simple and quick cleaning and maintenance operations.

What is claimed is:

1. A device for producing fibrous non-woven structures, comprising:

a first Venturi-type duct conveying an air flow over the lateral surface of a carding cylinder to remove fibers from the lateral surface of said carding cylinder and to convey the fibers to a mobile forming surface for said non-woven structures;

a second duct connected to the first duct at a position downstream of the point where fiber is removed from the lateral surface of the carding cylinder, wherein a flow of compressed air is fed through said second duct to create in the first duct the air flow removing the fibers; and an adjusting member to adjust the outlet section of said second duct where the second duct is connected to the first duct.

2. A device according to claim 1, wherein the second duct includes two walls, and the adjusting member consists of a cylinder, whose lateral surface represents a final part of one of the two walls of said second duct and a part of said first duct, wherein said cylinder is adjustable in its position to modify the outlet section of said second duct.

3. A device according to claim 2, wherein the cylinder leans with its lateral surface on movable blocks.

4. A device according to claim 3, wherein the blocks are cooperating with adjusting bolts.

5. A device according to claim 1, wherein the first duct includes a wall, which is opposite to the adjusting member and is transversely movable.

6. A device according to claim 5, wherein the wall of the first duct leans on the lateral surface of an eccentrically adjustable cylinder.

7. A device according to claim 5, wherein adjusting bolts, connected to the device, are attached to the wall of the first duct.

8. A device according to claim 1, wherein an adjusting mechanism is adjacent an outlet end of said first duct and is utilized to convey the fibers.

9. A device according to claim 8, wherein said adjusting mechanism consists of a second cylinder with its lateral surface detached from a final part of the first duct, wherein the second cylinder is adjustable with respect to said final part.

10. A device for producing fibrous non-woven structures, comprising a first duct conveying an air flow over the lateral surface of a carding cylinder, to remove fibers from the lateral surface of said carding cylinder and to convey said fibers to a mobile forming surface for said non-woven structures; a second duct joining with the first duct, wherein a flow of compressed air runs through said second duct to create, in the first duct, the air flow for removing the fibers; and further including an adjusting member faced to said first duct at the downstream end of said second duct to adjust its outlet section, wherein the first duct includes a wall, which is opposite to the adjusting member and is transversely movable; and the wall of the first duct leans on the lateral surface of an eccentrically adjustable cylinder.

* * * * *